US007056158B2

(12) United States Patent
Kuroda et al.

(10) Patent No.: US 7,056,158 B2
(45) Date of Patent: Jun. 6, 2006

(54) SOCKET CONTACT AND SOCKET CONNECTOR

(75) Inventors: Keiji Kuroda, Amagasaki (JP); Kiyoshi Aramoto, Higashiosaka (JP); Koji Iwashita, Nisshin (JP)

(73) Assignee: J.S.T. Manufacturing Co., Ltd., Osaka (JP)

( * ) Notice: Subject to any disclaimer, the term of this patent is extended or adjusted under 35 U.S.C. 154(b) by 0 days.

(21) Appl. No.: 10/465,604

(22) Filed: Jun. 20, 2003

(65) Prior Publication Data

US 2003/0236035 A1 Dec. 25, 2003

(30) Foreign Application Priority Data

Jun. 20, 2002 (JP) ..... 2002-179552

(51) Int. Cl.
*H01R 13/432* (2006.01)

(52) U.S. Cl. ..... 439/748; 439/752.5

(58) Field of Classification Search ..... 439/748, 439/746, 747, 752.5
See application file for complete search history.

(56) References Cited

U.S. PATENT DOCUMENTS 4,274,701 A * 6/1981 Bannert et al. ..... 439/748
4,379,611 A * 4/1983 Foege et al. ..... 439/747
5,489,223 A * 2/1996 Faje et al. ..... 439/748
5,911,603 A * 6/1999 Mansutti ..... 439/748
6,050,860 A * 4/2000 Tsuchiya ..... 439/748
6,066,007 A * 5/2000 Huang ..... 439/748
6,120,333 A * 9/2000 Ko ..... 439/748
6,183,312 B1 * 2/2001 Yamamoto ..... 439/748
6,280,250 B1 * 8/2001 Ko ..... 439/595
6,302,748 B1 * 10/2001 Xu et al. ..... 439/752.5

FOREIGN PATENT DOCUMENTS

JP 10-125384 * 5/1998
JP 2000-252005 * 9/2000

* cited by examiner

*Primary Examiner*—Gary Paumen
(74) *Attorney, Agent, or Firm*—Antonelli, Terry, Stout & Kraus, LLP.

(57) ABSTRACT

A socket connector (35) has a socket contact (1) installed in it, the contact being for connection with a wire end (20) in isolated compartment (26) of an insulating housing (25), the contact having a body (2) U-shaped in cross section composed of bent-up lateral walls (4) and a bottom (3). A lance (10) formed by punching the bottom protrudes outwards to be of the same width as a transverse width of the bottom and have two bent portions. One of the bent portions is located at a basal end (11) of the lance, and the other at a middle region (14) of the lance, thereby affording improved rigidity and resiliency to the lance. The bottom (3) has a broadened inner end (17) of the same width as a transverse width of contact body (2), so that the lance is of an improved rigidity and resiliency to be firmly retained in a connector housing not to slip off, even if made smaller in size.

5 Claims, 5 Drawing Sheets

SOCKET CONTACT AND SOCKET CONNECTOR

FIELD OF THE INVENTION

The present invention relates to a socket contact and a socket connector that are relatively smaller in size adapted for use where high voltages are applied to them.

PRIOR ART

Back-lights are used as the light sources for liquid crystal displays incorporated in personal computers. Power source circuits for such back-lights are connected to the outside through electric connectors, that are desirably smaller-sized and resistant to high voltages. Some connectors of this kind are known in the art (see for example the Japanese Patent Laying-Open Gazettes No. 10-125384 and No. 2000-252005). Socket contacts secured on wire ends are isolated from each other, since they are held in respective compartments formed in an insulating housing. Each socket contact has a bottom, and whose portion provides a lance pressed outwards from it so as to engage with a slot or lug formed in the insulated housing, thus retaining the contact therein.

However, such a lance is not necessarily large enough to ensure a firm retention of the contact, particularly if connectors and their contacts are made smaller and smaller. If a stretching, wrenching or the like external force is imparted to the wire end secured in the contact, then it will likely be unintentionally and undesirably removed from the insulating housing.

The socket contacts in high-voltage connectors should reliably be kept stable within the housing, so that connector can operate safe well even under considerably high-voltage conditions.

SUMMARY OF THE INVENTION

The present invention was made to resolve the drawbacks inherent in the prior art, and also in order to meet the requirement just mentioned above. Its object is therefore to provide a socket contact and a socket connector comprising same, such that a lance will maintain its rigidity and resiliency within the contact even if the latter is made smaller in size. Retention of each contact in the insulating housing by means of such a lance has to be improved herein so as to avoid any unintentional removal of the socket contact out of said housing.

In order to achieve this object, the present invention will provide a socket contact for connection thereof with a wire end and for isolated accommodation thereof in a compartment that is formed in an insulating housing, the contact having a body composed of lateral walls and a bottom such that these walls bent up and continuing from the bottom do render the contact body generally U-shaped in cross section. The contact has a lance formed by punching the bottom so as to protrude outwards, and the lance generally of the same width as a transverse width of the bottom does have two bent portions. One of these bent portions is disposed close to a basal end of said lance, with the other bent portion located at a middle region intermediate between the basal end and a free end of said lance, thereby affording improved rigidity and resiliency to the lance.

Preferably, the other bent portion may be disposed remote from the free end and rather near the one bent portion of the lance so that its resiliency is improved much more.

From another aspect of the invention, it provides a socket connector comprising at least one socket contact for connection thereof with a wire end and for isolated accommodation thereof in at least one compartment formed in an insulating housing, the contact having a body composed of lateral walls and a bottom such that these walls bent up and continuing from the bottom do render the contact body generally U-shaped in cross section. The contact has a lance formed by punching the bottom so as to protrude outwards, and the lance generally of the same width as a transverse width of the bottom does have two bent portions. One of these bent portions is disposed close to a basal end of said lance, with the other bent portion located at a middle region intermediate between the basal end and a free end of said lance, thereby affording improved rigidity and resiliency to the lance. An inner wall surface defining each compartment of the insulating housing has formed therein side grooves for engagement with the lateral walls of the contact body. These grooves have to inhibit the socket contact from leaning sideways or shaking randomly within the compartment, lest the lance should disengage from a slot or lug that is formed in the insulating housing.

Preferably, the bottom of the contact body may have a broadened inner end portion that is generally of the same width as a transverse width of said contact body. In this case, the socket contact will further be protected from leaning sideways or shaking randomly within the compartment, lest the lance should disengage from the slot or lug of the housing.

THE PREFERRED EMBODIMENTS

Figure 1:
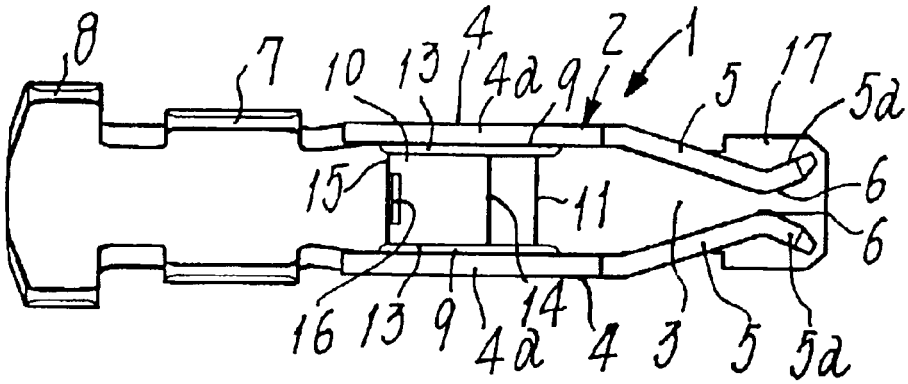
FIG. 1 is a plan view of a socket contact provided herein.

Now some embodiments of the present invention will be described in detail, referring to the drawings.

Figure 2:
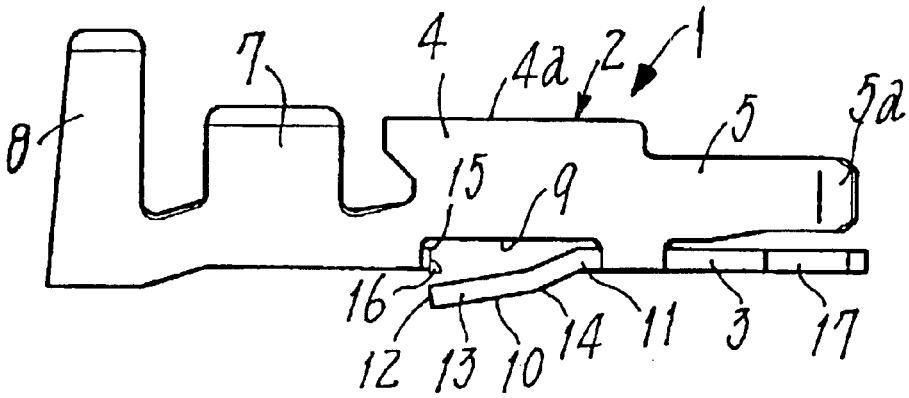
FIG. 2 is a front elevation of the contact shown in FIG. 1.
Figure 3:
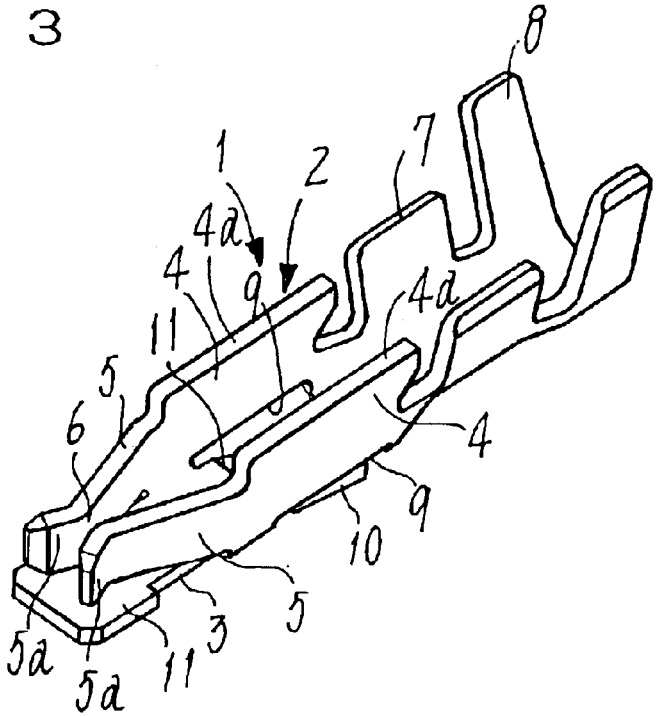
FIG. 3 is an overhead perspective view of the contact shown in FIG. 1.
Figure 4:
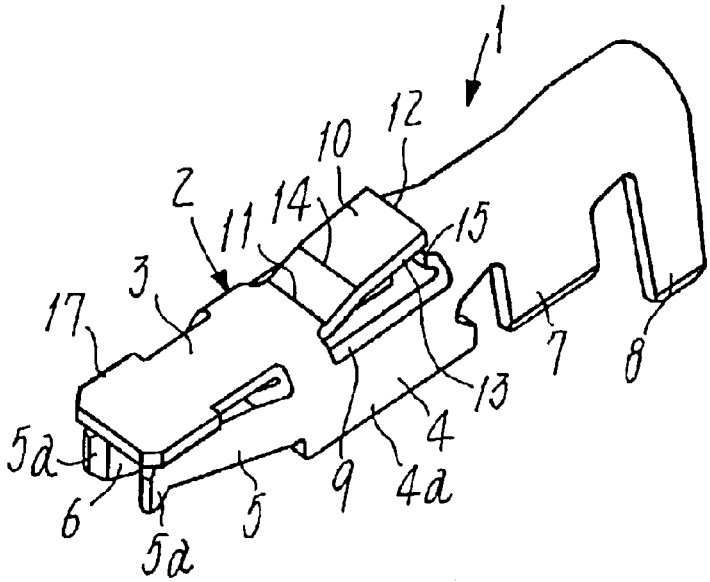
FIG. 4 is an upward perspective view of the contact shown in FIG. 1.

A socket contact 1 of the invention illustrated in FIGS. 1 to 4 is a conductive piece made by pressing a thin metal plate such as a phosphor bronze plate. A body 2 of this contact is composed of a bottom 3 and a pair of lateral walls 4 bent upwards. These walls 4 continue from a middle region of the bottom 3 so as to render the contact body 2 generally U-shaped in cross section. A pair of resilient contact leaves 5 protrudes inwards from the inner ends of respective lateral walls 4. These contact leaves 5 are slanted to become closer and closer to each other as they extend inwards to terminate short of the inner end of bottom 3. However, the inner end portions 5*a* of such resilient leaves 5 are then bent sideways and away from each other to pro-vide contact surfaces 6. A pin contact (not shown) of a mating connector will fit in between the contact surfaces 6 of these leaves 5. U-shaped gripping sections 7 and 8 continue outwards from the outer ends of bottom 3 and lateral walls 4. One of such gripping sections 7 will be crimped on a core 21 of a wire end 20, with the other 8 being crimped on an insulating cover 22 of the wire end.

The middle region of bottom 3 is punched downwards to form a lance 10 whose basal end 11 is integral with the rearward end of inner or forward portion of the bottom. The lance 10 slanted downwards and rearwards has a rear edge as a free end 12 that will serve to lock the contact body in position in an insulating housing 25 (detailed below) as is in the prior art connectors of this type. As seen in the drawings, side edges 13 of the lance 10 originate from the corresponding sides of cutouts 9 that have previously been formed by punching the bottom middle region where the lateral walls 4 are bent up later. Thus, the lance 10 substantially of the same width as a transverse width of bottom 3 is much broader than the prior art lances of this type. The lance 10 has two bent portions, and one of them is located at the basal end 11, with the other disposed at a middle region 14 between the basal and free ends so that its rigidity and resiliency are improved to enhance its effect of retention. One of edges 15 defining in the bottom 3 a vacant space from which the lance 10 has been pressed out is caulked with a punch or the like to give a protrusion 16. This protrusion will protect the lance 10 from being forced into the contact body 2 due to any unordinary external force.

The bottom 3 extends inwardly to the inner end portions 5*a* of such resilient leaves 5, so as to form there a broadened inner end portion 17 of a width generally equal to or slightly greater than a transverse width of contact body 2.

Figure 5:
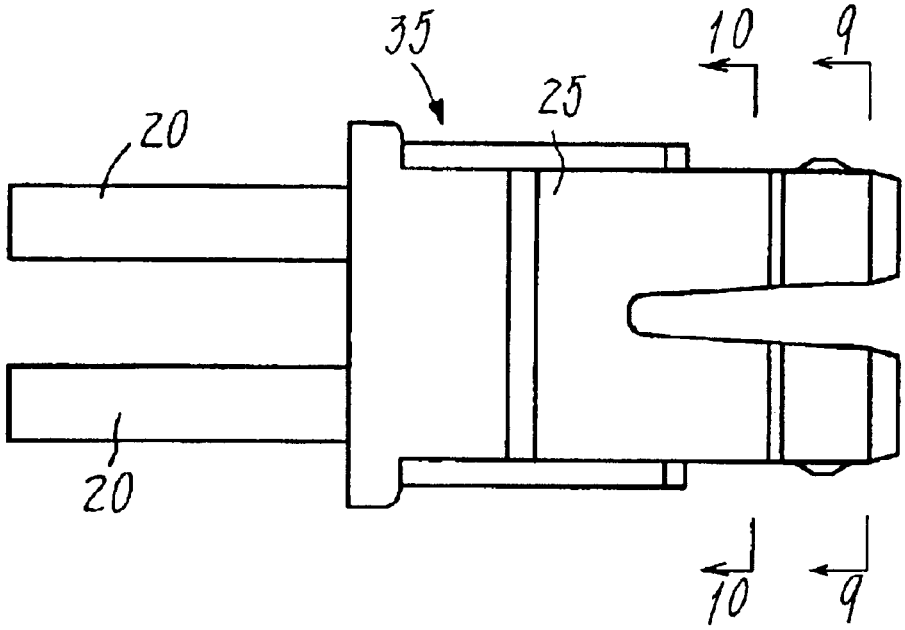
FIG. 5 is a plan view of a socket connector also provided herein.
Figure 6:
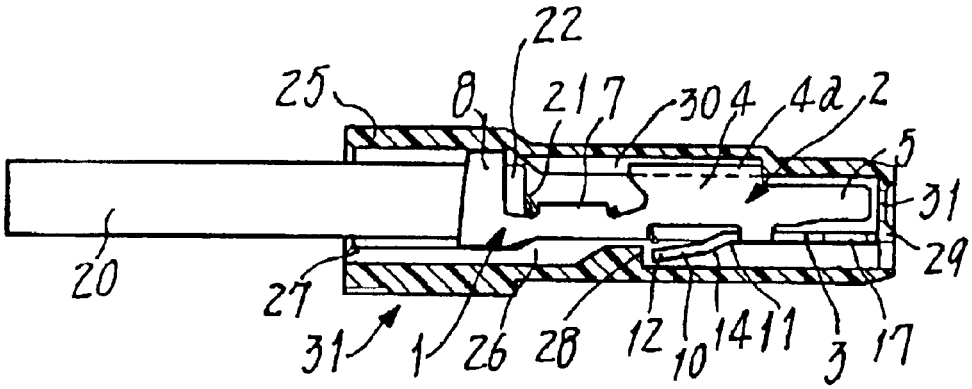
FIG. 6 is a vertical cross section of the connector shown in FIG. 5.
Figure 7:
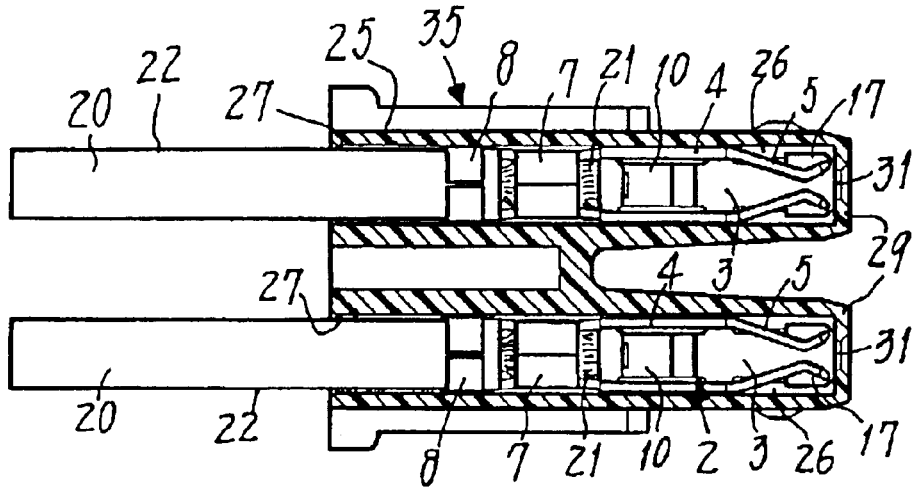
FIG. 7 is a horizontal cross section of the connector shown in FIG. 5.
Figure 8:
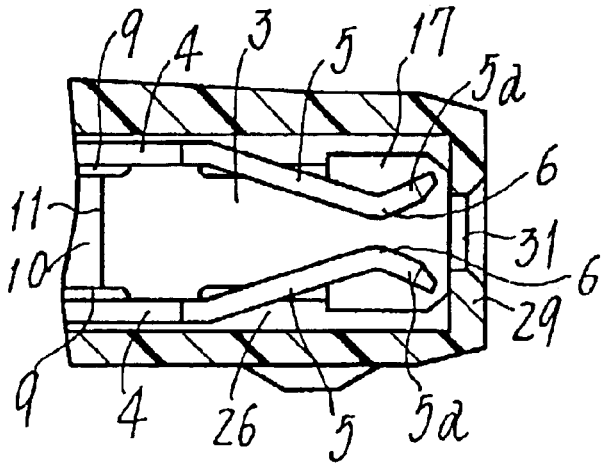
FIG. 8 is an enlarged portion of FIG. 7.
Figure 9:
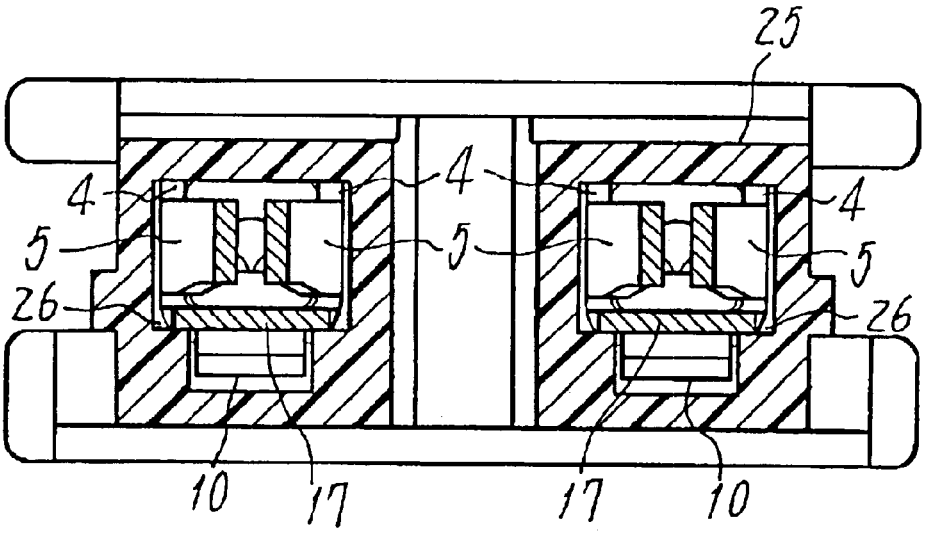
FIG. 9 is an enlarged cross section that is taken along the line 9—9 in FIG. 5.
Figure 10:
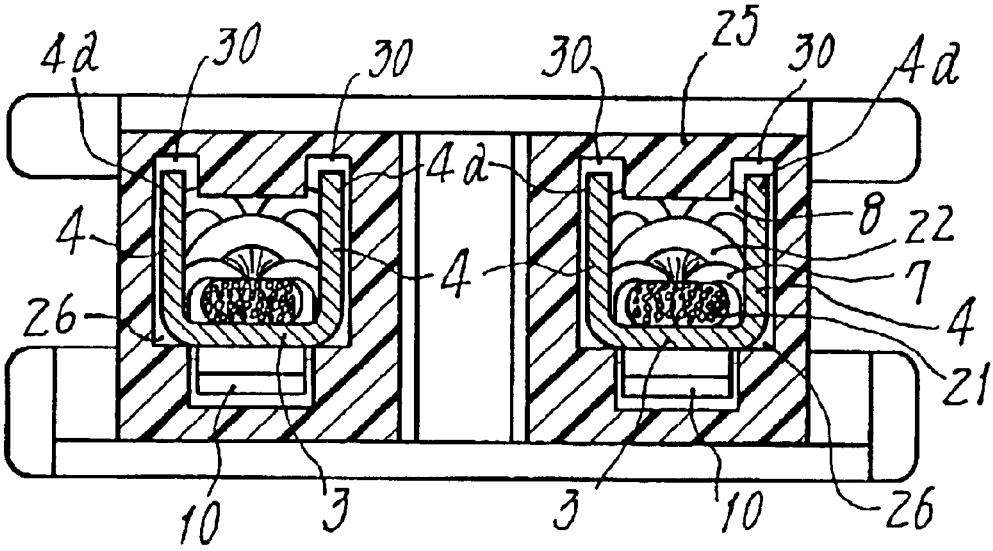
FIG. 10 is an enlarged cross section likewise taken along the line 10—10 in FIG. 5.

FIGS. 5 to 10 show a socket connector 35 comprising for instance two socket contacts 1, each of them having been described above. A wire end 20 is secured to each contact 1, by crimping the gripping section 7 on a core 21 of a wire end 20, with the other gripping section 8 being crimped on an insulating cover 22 of the wire end. Each socket contact 1 will then be placed in the insulating housing 25 (mentioned above) made of a non-conductive plastics such as Nylon (registered trademark). In detail, the contact 1 will be inserted through a rear moth 27 into a compartment or chamber 26 formed in the housing 25. The free end 12 of each contact 1 placed in the chamber 26 engages with a lug 28 protruding from a bottom wall of chamber, disabling withdrawal of the contact 1 therefrom. In this state of the members, an inner tip of the broadened inner end portion 17 extending from the bottom 3 is in contact with the inner surface of a forward end wall 29 of chamber 26, inhibiting the contact 1 from slipping off forwards. As will be seen best in FIG. 10, tops of the lateral walls 4 of contact body 2 are in engagement with side grooves 30 extending longitudinally of a ceiling of said chamber. The contact body 2 firmly held in place in this manner will not allow the contact 1 as a whole to lean sideways or shake in any direction. It will now be apparent that, firstly, the lance 10 of the contact 1 secured in the chamber 26 of housing 25 is almost as wide as the bottom 3 and has the two bent portions 11 and 14 at its basal end and middle portion, so that its rigidity and resiliency are improved to an excellent degree. By virtue of this structure, any stretching, wrenching or the like stress occasionally imparted to the wire end 20 will not cause the lance 10 to disengage from the lug 28, thus reliably holding the contact 1 in the housing 25. Secondly, because the tops of lateral walls 4 of contact body 2 fit in the side grooves 30, and these lateral walls 4 as well as side edges of broadened inner end portion 17 extending from bottom 3 are all disposed close to the inner wall surfaces of chamber 26, the leaning or shaking of contact 1 within chamber 26 is surely avoided neither to cause any disengagement of lance 10 from lug 28, nor to cause any slipping off of contact 1 out of chamber 26 or housing 25.

The socket connector 35 of the described structure will fit on a mating connector not shown. In detail, the mating pin contacts will be inserted through mouths 31 formed in the forward end wall 29, introducing them in between the resilient contact leaves 5, so as to establish electric connection between each socket contact and the corresponding pin contact.

In summary, the socket contact of the invention can have a lance whose rigidity and resiliency are improved to such a degree that it is firmly retained in a housing not to slip off therefrom, even if it is made smaller in size. Therefore, the socket connector comprising the contact or contacts installed in the housing is suited for use as high-voltage type connectors that are of a smaller size and nevertheless resistant to high voltages.

What is claimed is:

1. A socket contact for connection thereof with a wire end and for isolated accommodation thereof in a compartment that is formed in an insulating housing, the contact having a body composed of lateral walls and a bottom such that these walls bent up and continuing from the bottom do render the contact body generally U-shaped in cross section, and a lance formed by punching the bottom so as to protrude outwards, wherein the bottom of the contact body has a broadened inner end portion generally of the same width as a transverse width of said contact body, and the lance being generally of the same width as a transverse width of the bottom, side edges of the lance originating from corresponding sides of cutouts that have been formed by said punching the bottom, at a middle region thereof, with the lateral walls being bent up subsequent to said punching, and the lance having two bent portions, wherein one of these bent portions is disposed close to a basal end of said lance, with the other bent portion located at a middle region intermediate between the basal end and a free end of said lance, thereby affording improved rigidity and resiliency to the lance, and wherein the contact further comprises resilient leaves extending from the lateral walls, and overlaying and being spaced from the broadened inner end portion of the bottom of the contact body.

2. A socket contact as defined in claim 1, wherein a width between the resilient leaves at said broadened inner end portion of said bottom of the contact body is less than the width of the bottom of the broadened inner end portion of the contact body.

3. A socket contact as defined in claim 1, wherein the resilient leaves have a decreasing width therebetween in a first part thereof extending from the lateral walls and a second part extending from the first part whose width therebetween increases.

4. A socket connector comprising at least one socket contact for connection thereof with a wire end and for isolated accommodation thereof in at least one compartment formed in an insulating housing, the contact having a body composed of lateral walls and a bottom such that these walls bent up and continuing from the bottom do render the contact body generally U-shaped in cross section, and a lance formed by punching the bottom so as to protrude outwards, wherein the bottom of the contact body has a broadened inner end portion generally of the same width as a transverse width of said contact body, and the lance is generally of the same width as a transverse width of the bottom, side edges of the lance originating from corresponding sides of cutouts that have been formed by said punching the bottom, at a middle region thereof, with the lateral walls being bent up subsequent to said punching, and the lance having two bent portions, wherein one of these bent portions is disposed close to a basal end of said lance, with the other bent portion located at a middle region intermediate between the basal end and a free end of said lance, thereby affording improved rigidity and resiliency to the lance, wherein the contact further comprises resilient leaves extending from the lateral walls, and overlying and being spaced from the broadened inner end portion of the bottom of the contact body, and wherein an inner wall surface defining each compartment of the insulating housing has formed therein side grooves for engagement with the lateral walls of the contact body.

5. A socket connector as defined in claim 4, wherein an inner tip of the broadened inner end portion of the contact body is adapted to be in contact with the inner wall surface of a forward end wall of a compartment of the insulating housing.

* * * * *